US006485066B1

(12) United States Patent
Nigro, Jr. et al.

(10) Patent No.: US 6,485,066 B1
(45) Date of Patent: Nov. 26, 2002

(54) EXIT ALARM LOCK DEADBOLT HAVING GUIDE SUPPORTS

(75) Inventors: Daniel N. Nigro, Jr., Ocean Springs, MS (US); Eugene Karl Siller, Indianapolis, IN (US)

(73) Assignee: Von Duprin, Inc., Indianapolis, IN (US)

( * ) Notice: Subject to any disclaimer, the term of this patent is extended or adjusted under 35 U.S.C. 154(b) by 0 days.

(21) Appl. No.: 09/565,348

(22) Filed: May 5, 2000

Related U.S. Application Data

(60) Provisional application No. 60/133,007, filed on May 7, 1999.

(51) Int. Cl.[7] ..... E05C 1/02

(52) U.S. Cl. ..... 292/137; 292/DIG. 51

(58) Field of Search ..... 292/92, 163, 164, 292/167, 169.14, 169.17, 169, 170, 140, 137, DIG. 51, DIG. 55, DIG. 57; 70/92

(56) References Cited

U.S. PATENT DOCUMENTS

| | | | | |
|---|---|---|---|---|
| 513,279 | A | * | 1/1894 | Ridgway |
| 687,644 | A | * | 11/1901 | Milliron |
| 2,223,186 | A | * | 11/1940 | Rightmyer |
| 5,553,903 | A | * | 9/1996 | Prete |
| 6,174,005 | B1 | * | 1/2001 | Norton |

* cited by examiner

*Primary Examiner*—Flemming Saether
(74) *Attorney, Agent, or Firm*—Michael Best & Friedrich LLP

(57) ABSTRACT

A sliding deadbolt for use with an exit alarm lock having deadbolt guide supports which are closer to the centerline of the deadbolt than the point at which the exit alarm lock drivers contact the deadbolt to move the deadbolt between a retracted position and an extended position. By placing the guide supports closer the deadbolt centerline, the resistive forces between the deadbolt and the support/bolt contact points as a result of loads on the deadbolts (such as from the exit alarm lock drives), are reduced.

7 Claims, 3 Drawing Sheets

EXIT ALARM LOCK DEADBOLT HAVING GUIDE SUPPORTS

This application claims the benefit under 35 U.S.C. §119 (e) of the U.S. provisional application No. 60/133,007 filed May 7, 1999.

BACKGROUND OF THE INVENTION

This invention relates generally to deadbolts and more particularly to deadbolts for exit alarm locks.

An exit alarm lock is a door lock assembly that sounds an audible horn or alarm at the push-activated release of the locking element. These products are often used on the back doors of retail establishments such as restaurants and strip malls as a deterrent to unauthorized egress through the doors upon which the devices are installed. Their use is typically provoked by a security event such as internal losses by employees or customers. Because internal as well as external security is an important issue for the doors upon which these devices are installed, it important that the design of the latching be robust and dependable. As these devices must release the latching quickly in the event of a panic situation, the design of the releasing mechanism must also be durable and consistent. The deadbolt must then provide the attribute of high security in an extended position while being able to quickly and easily move to a retracted position upon authorized disarming or unauthorized depression of the pushpad.

The foregoing illustrates limitations known to exist in present exit alarm lock deadbolts Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing in combination: a sliding deadbolt having a centerline extending parallel to the direction of sliding and having at least one driver contact located a first distance from the centerline; and a plurality of guide supports in sliding engagement with the deadbolt, each guide support being a predetermined distance from the centerline, each predetermined distance being less than the first distance.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1A:
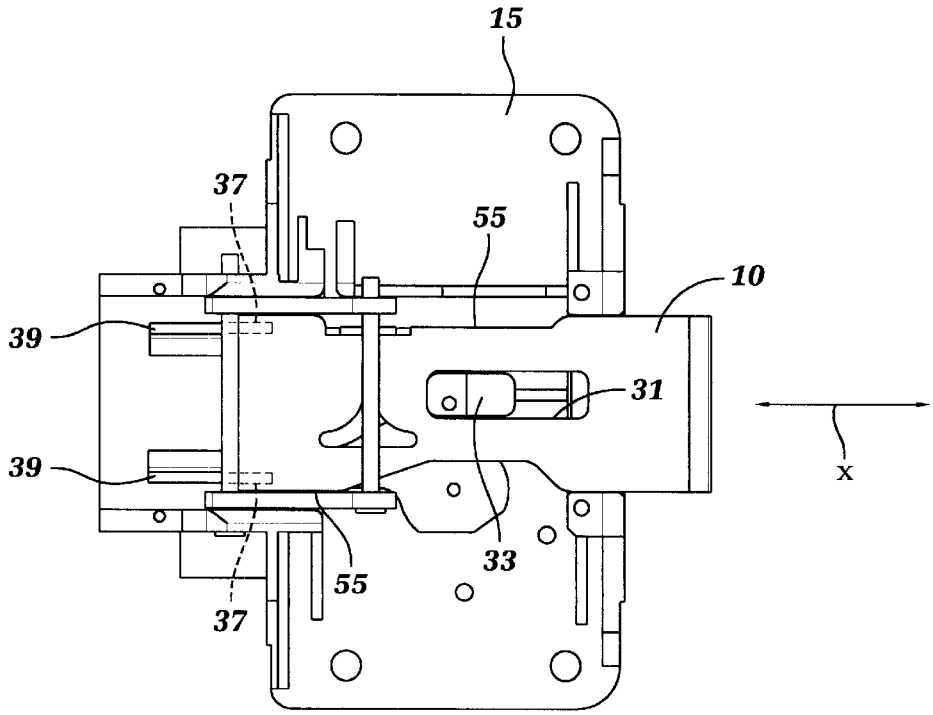
FIGS. 1A through 1C show plan views of the deadbolt of the present invention in three different positions of operation, extended, transition between extended and retracted, and retracted respectively.
Figure 1B:
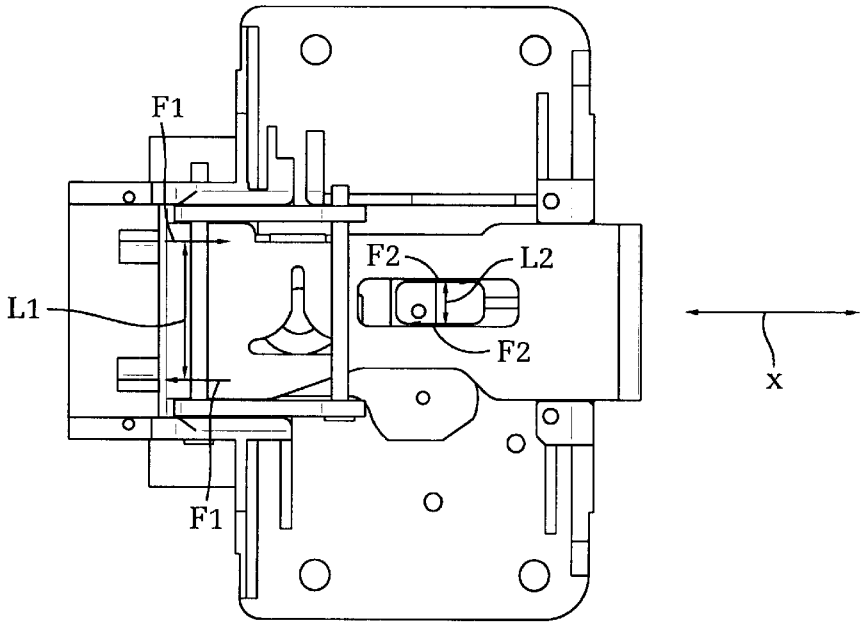
Figure 1C:
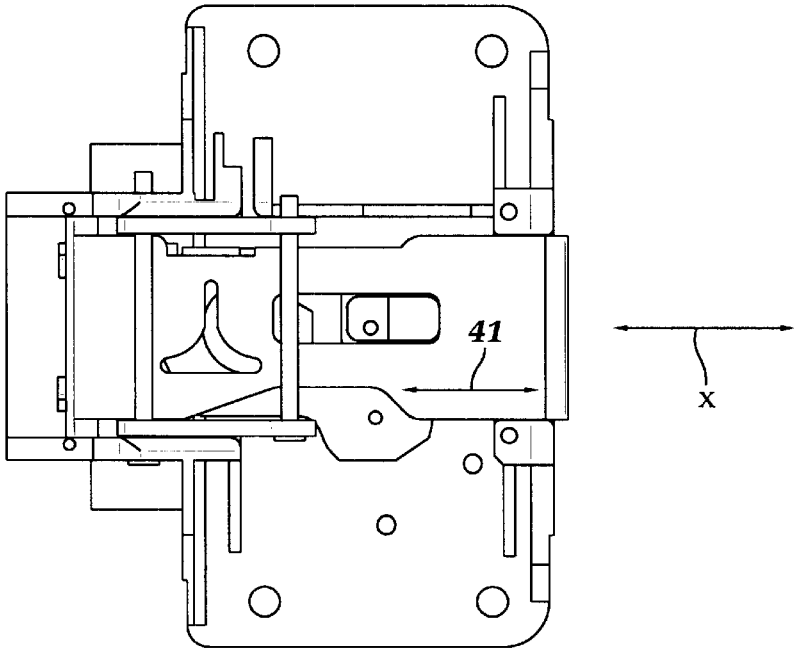
Figure 2:
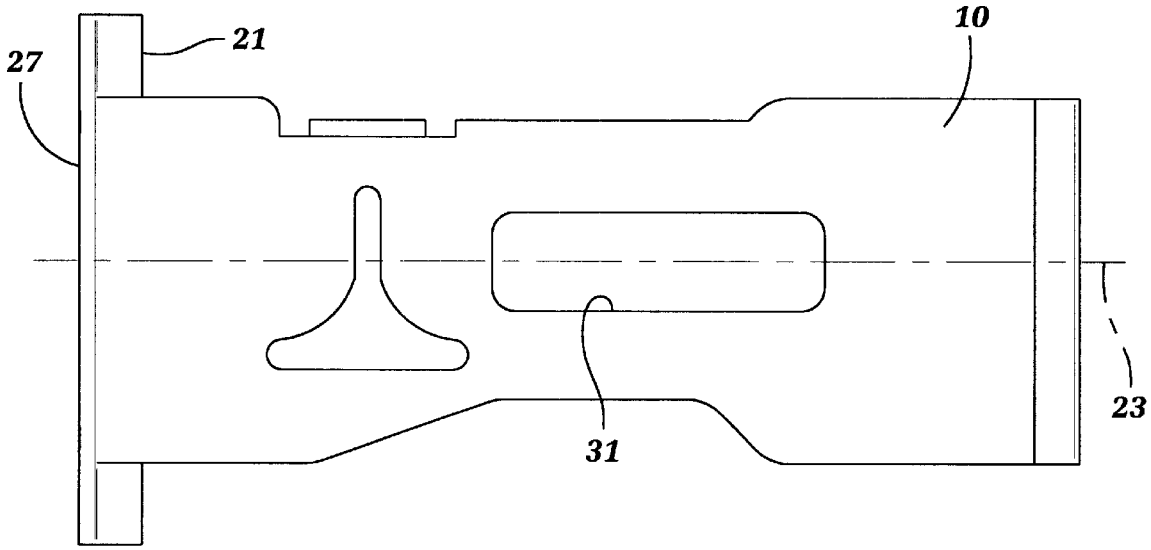
FIG. 2 is a plan view of the sliding deadbolt shown in FIG. 1A.
Figure 3:
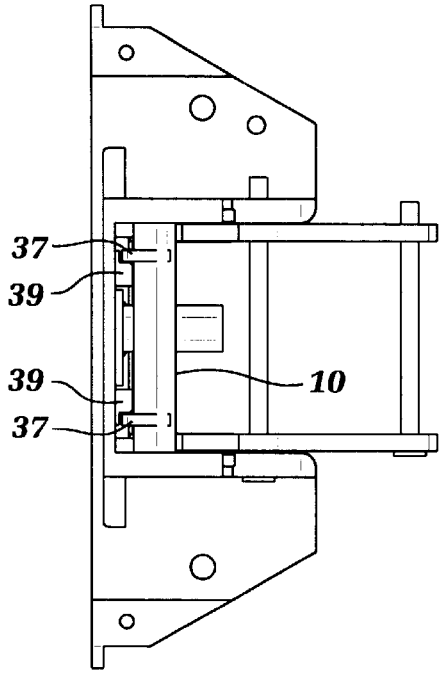
FIG. 3 is a left end view of the deadbolt shown in FIG. 1C.
Figure 4:
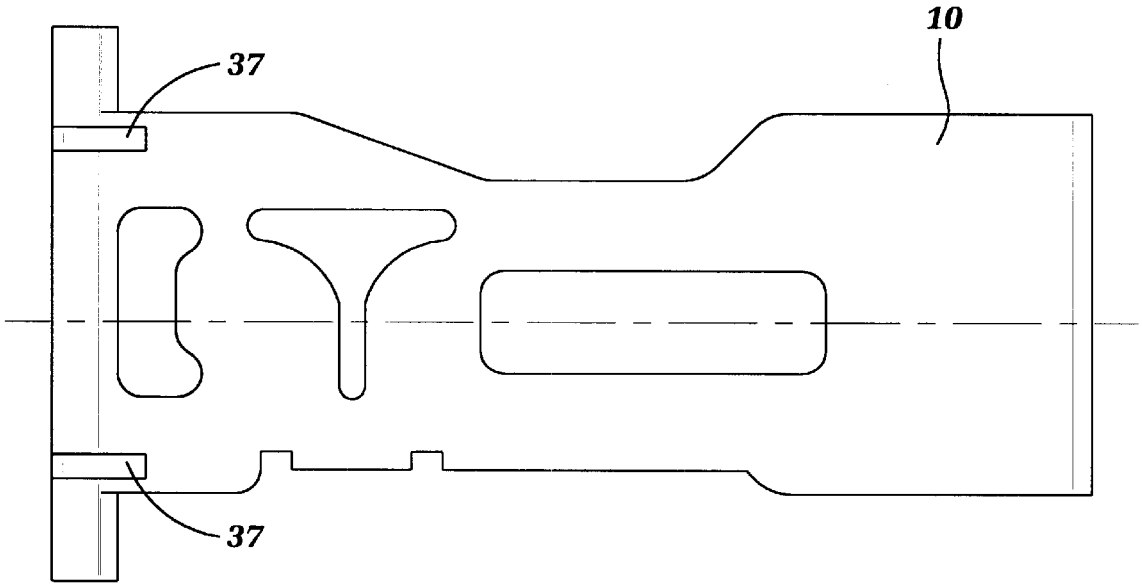
FIG. 4 is a bottom view of the sliding deadbolt shown in FIG. 1A, illustrating the rear support rails.

FIGS. 1A through 1C illustrate a sliding deadbolt 10 for use with an exit alarm lock, such as that described in provisional patent applications Nos. 60/134,013, 60/134,014 and 60/133,027, the disclosures of which are hereby incorporated by reference. Preferably, deadbolt 10 is a stainless steel cast deadbolt to provide a higher level of security.

Since the deadbolt slides along its axis in direction 41 between the extended position (FIG. 1A) and the retracted position (FIG. 1C), it is important that the support design thwart any excessive resistance or friction binding. This is accomplished in the present invention by bringing the guide supports as close to the centerline 23 of the sliding deadbolt 10 as possible. Referencing FIG. 1A, it can be seen that the deadbolt 10 rests within the lock housing 15 which is designed to allow freedom of sliding along the X axis in direction 41. Typically the exit alarm lock (or other type of exit device) uses a bell crank (not shown) to contact the deadbolt 10 at shoulders 21 which are seen to be the furthest points from the deadbolt centerline 23.

The deadbolt guide supports include 1) a forward support slot 31, approximately in the center of the deadbolt 10 with the centerline 23 passing through the slot 31 and a forward support post 33 extending from the lock housing 15 through the slot 31 and being in sliding contact with the slot 31 and 2) two rear support rails 37 extending from a lower surface 28*a* of the deadbolt 10 proximate a rear end 27 of the deadbolt and being in sliding engagement with two rear support posts 39 extending from the lock housing 15. These guide supports 31 and 33, and 37 and 39 constrain the deadbolt 10 to slide along the X axis in direction 41 between its extended and retracted positions.

In bringing these supports to the inside of the bell-crank contact points on the deadbolt shoulders 21, the resistive forces which oppose bolt motion are considerably lower than if the supports were brought to the outside faces 55 of the deadbolt 10. This can be explained by referencing FIG. 1B. The most likely instance for deadbolt binding occurs when component variation and assembly tolerance creates a situation in which one of the deadbolt shoulders is contacted by the bell crank before the other. In this case, the retraction force "P" is hindered by the resistive forces F1 and F2 which act in the direction to oppose motion. Each of these resistive forces creates a resistive moment, or couple, equal to the force (F)×the distance (L) between them. The smaller the distance L, then the smaller the product of F×L. As this couple is minimized by shortening the length of L1 and L2, the resistive couple is unable to bind the deadbolt and impede its motion.

The primary functions of the deadbolt in an exit alarm lock are to secure the opening when extended and to allow consistent retraction when depression of the pushbar occurs thereby unlatching the door. Because situations can arise in which people must exit a building quickly, it is critical that the deadbolt retraction operate reliably and with low resistive forces.

In designing the support guides as closely to the deadbolt centerline as possible, resistive couples which can act to bind the deadbolt are minimized ensuring reliable and consistent retraction. This practice gives the device a greater immunity to in operation as a result of component variation and assembly tolerance while preserving the high security functionality of the device.

Having described the invention, what is claimed is:

1. In combination:

a sliding deadbolt having a first side and a second side, the sliding bolt having a centerline extending between the first side and the second side parallel to the direction of sliding, the deadbolt having at least one driver contact located a first distance from the centerline, the deadbolt having a forward support slot therein, the centerline extending through the forward support slot, and the deadbolt having at least one rear support rail;

a forward support post extending through the forward support slot, the forward support post being in sliding engagement with the deadbolt, the centerline extending through the forward support post; a first rear support post in sliding engagement with a first rear support rail at the first side of the deadbolt, the first rear support post being a predetermined distance from the centerline and a second predetermined distance rearward of the forward support post; and a second rear support post in sliding engagement with a second rear support rail at the second side of the deadbolt, the second rear support post being the predetermined distance from the centerline and the second predetermined distance rearward of the forward support post.

2. The combination according to claim 1, wherein the deadbolt has a front surface, a rear surface, a front end, and a rear end, the rear support rails being on the rear surface proximate the rear end of the deadbolt.

3. The combination according to claim 1, wherein the driver contact comprises a shoulder extending from the deadbolt.

4. In combination:

a sliding deadbolt having a front surface, a rear surface, a front end, a rear end and a centerline extending parallel to the direction of sliding, the deadbolt having at least one driver contact located a first distance from the centerline, the deadbolt having a forward support slot therein, the centerline extending through the forward support slot, and the deadbolt having two rear support rails on the rear surface proximate the rear end; and a housing plate having a plurality of guide supports thereon, each guide support being in sliding engagement with the deadbolt, one of the plurality of guide supports comprising a forward support post extending through the forward support slot, the other of the plurality of guide supports comprising two rear support posts in sliding engagement with the rear support rails, the two rear posts supports being on opposite sides of the centerline, the two rear posts being spaced a predetermined distance from the centerline and being a second predetermined distance rearward of the forward support slot.

5. The combination according to claim 4, wherein the rear support rails and the rear support posts extend in a direction parallel to the centerline.

6. A deadbolt for use with an exit device, the exit device having at least one driver for contacting the deadbolt and moving the deadbolt between an extended position and a retracted position, the deadbolt comprising:

a sliding deadbolt having a first side and a second side, the sliding bolt having a centerline extending between the first side and the second side parallel to the direction of sliding and having at least one driver contact adapted for engaging contact with the at least one driver and being located a first distance from the centerline, the deadbolt having a forward support slot therein, the centerline extending through the forward support slot;

a forward support post extending through the forward support slot, the forward support post being in sliding engagement with the deadbolt, the centerline extending through the forward support post;

a first rear support post in sliding engagement with a first rear support rail at the first side of the deadbolt, the first rear support post being a predetermined distance from the centerline and being a second predetermined distance rearward of the forward support post; and a second rear support post in sliding engagement with a second rear support rail at the second side of the deadbolt, the second rear support rail being the predetermined distance from the centerline and the second predetermined distance rearward of the forward support post, the predetermined distance being less than the first distance.

7. The deadbolt according to claim 6, wherein the sliding deadbolt has a front surface, a rear surface, a front end, a rear end and the rear support rails on the rear surface proximate the rear end, and the first guide support being in sliding engagement with the rear support rail.

* * * * *